US012402731B1

(12) United States Patent
Kim et al.

(10) Patent No.: US 12,402,731 B1
(45) Date of Patent: Sep. 2, 2025

(54) REFLUX-PREVENTING CUSHION FOR COMBINED USE AS BABY BED HAVING FIXING BAND THAT IS ANGLE-ADJUSTABLE AND MADE OF SOFT MATERIAL

(71) Applicant: Angel & Bee Inc., Hanam-si (KR)

(72) Inventors: Dong Eun Kim, Seoul (KR); Yun Hyeong Chun, Seoul (KR)

(73) Assignee: Angel & Bee Inc., Hanam-si (KR)

( * ) Notice: Subject to any disclaimer, the term of this patent is extended or adjusted under 35 U.S.C. 154(b) by 0 days.

(21) Appl. No.: 19/217,258

(22) Filed: May 23, 2025

(30) Foreign Application Priority Data

May 23, 2024 (KR) ..... 20-2024-0000910

(51) Int. Cl.
*A47D 13/08* (2006.01)
*A47D 15/00* (2006.01)

(52) U.S. Cl.
CPC ..... *A47D 13/08* (2013.01); *A47D 13/083* (2013.01); *A47D 15/008* (2013.01); *A47D 15/005* (2013.01)

(58) Field of Classification Search
CPC .... A47D 13/08; A47D 13/083; A47D 15/008; A47D 15/005; A47D 15/001; A47D 9/00; A47C 20/027; A47C 20/02; A47C 20/04
See application file for complete search history.

(56) References Cited

U.S. PATENT DOCUMENTS 4,441,221 A * 4/1984 Enste ..... A47D 15/008 297/118
4,802,244 A * 2/1989 McGrath-Saleh ..... A47D 13/08 2/69.5
5,115,529 A * 5/1992 White ..... A47D 13/08 297/440.22
6,922,861 B1 * 8/2005 Mathis ..... A47D 15/008 5/915
10,363,186 B2 * 7/2019 Bader ..... A47D 15/005
(Continued)

FOREIGN PATENT DOCUMENTS

EP 4245191 A1 9/2023
KR 20-2022-0000673 U 3/2022
(Continued)

OTHER PUBLICATIONS

Angel&Bee. (Oct. 15, 2023). Anti-reflux cushion recommendation! Angel NB anti-reflux cushion that is easy on the waist and can adjust the angle! YouTube. https://www.youtube.com/watch?v=FvTiuspcFn4.

(Continued)

*Primary Examiner* — Robert G Santos
(74) *Attorney, Agent, or Firm* — Studebaker Brackett PLLC

(57) ABSTRACT

An embodiment of the present disclosure provides a reflux-preventing cushion for preventing digestive reflux that occurs in a newborn, the reflux-preventing cushion including a backrest cushion configured to be inclined at a certain angle and allow the newborn to be laid to prevent the digestive reflux, and a buttocks cushion including a pair of bands configured to cover the newborn from both sides of the body of the newborn in a state in which the newborn is laid on the backrest cushion, wherein an uninclined backrest cushion is further included on an upper portion of an inclined backrest cushion.

7 Claims, 7 Drawing Sheets

(56) References Cited

U.S. PATENT DOCUMENTS

| | | | | |
|---|---|---|---|---|
| 11,517,488 | B2 * | 12/2022 | Bader | A61G 7/065 |
| 2010/0287706 | A1 | 11/2010 | Nour | |
| 2016/0051430 | A1 * | 2/2016 | Bader | A47D 13/08<br>128/845 |
| 2019/0350787 | A1 * | 11/2019 | Bader | A47C 31/123 |

FOREIGN PATENT DOCUMENTS

| | | | | |
|---|---|---|---|---|
| KR | 20-2022-0001275 | U | 6/2022 | |
| KR | 200495824 | Y1 | 8/2022 | |
| KR | 200498451 | Y1 * | 10/2024 | A47D 15/005 |
| WO | 2021/053606 | A1 | 3/2021 | |
| WO | WO-2023174866 | A1 * | 9/2023 | A47C 27/15 |

OTHER PUBLICATIONS

Office Action issued in KR 20-2024-0000910; mailed by the Korean Intellectual Property Office on Aug. 2, 2024.
Office Action issued in KR 20-2024-0000910; mailed by the Korean Intellectual Property Office on Oct. 11, 2024.

* cited by examiner

REFLUX-PREVENTING CUSHION FOR COMBINED USE AS BABY BED HAVING FIXING BAND THAT IS ANGLE-ADJUSTABLE AND MADE OF SOFT MATERIAL

CROSS-REFERENCE TO RELATED APPLICATION

This application claims priority to and the benefit of Korean Patent Application No. 20-2024-0000910, filed on May 23, 2024, the disclosure of which is incorporated herein by reference in its entirety.

BACKGROUND

1. Field of the Invention

The technical idea of the present disclosure relates to a reflux-preventing cushion, and more particularly, to a reflux-preventing cushion for combined use as a baby bed having a fixing band that is angle-adjustable and made of a soft material.

2. Discussion of Related Art

The digestive systems of newborns, infants, and young children with low muscle mass are not yet fully developed and cannot be controlled smoothly. In particular, since the stomach capacity is small, and the muscles connecting the esophagus and stomach are not fully developed, a problem in which food that is eaten comes back up into the esophagus occurs. Therefore, newborns, infants, and young children are likely to vomit food if their posture changes due to tossing and turning, etc., because they usually spend their time lying down. This is a natural phenomenon, but since a problem may occur if the phenomenon repeatedly occurs, there is a need to prepare for it.

Conventionally, a general cushion, blanket, and the like have been used to correct the posture when necessary, but since it is difficult to continuously maintain the posture, a cushion or the like for infants and young children that has a function of elevating the head side has been developed and used in recent years. An example of such a cushion for infants and young children is disclosed in Korean Utility Model No. 20-0486564.

However, such a functional cushion has a shape that is inclined toward the lower body of a newborn, and the newborn slips due to the slope in some cases. In addition, when the cushion is too soft, it is difficult to correct the posture, and when the cushion is excessively hard, the baby may easily feel uncomfortable. There is a need for an improvement in relevant art in order to prevent a newborn from slipping from the functional cushion.

SUMMARY OF THE INVENTION

The present disclosure is directed to providing a reflux-preventing cushion that simultaneously prevents digestive reflux in a newborn and prevents the newborn from feeling uncomfortable.

According to an embodiment of the present disclosure, there is provided a reflux-preventing cushion for preventing digestive reflux that occurs in a newborn, the reflux-preventing cushion including a backrest cushion configured to be inclined at a certain angle and allow the newborn to be laid to prevent the digestive reflux, and a buttocks cushion including a pair of bands configured to cover the newborn from both sides of the body of the newborn in a state in which the newborn is laid on the backrest cushion.

According to one embodiment, the pair of bands may include a first band including a first surface woven using a first plain gauze weave method and a second band including a second surface woven using a second plain gauze weave method different from the first plain gauze weave method, and the pair of bands may fix the newborn through fastening between the first surface and the second surface.

According to one embodiment, in the first plain gauze weave method, a plurality of 200 denier first filament bundles in which 90 to 100 filament fibers are tied into one strand and a plurality of 100 denier second filament bundles in which 40 to 50 filament fibers are tied into one strand may be mixed.

According to one embodiment, in the second plain gauze weave method, the 200 denier first filament bundles and 100 denier island-in-sea fiber yarn may be mixed, and when the first band and the second band are fastened, a portion of the second surface woven using the second plain gauze weave method may be disposed toward the newborn.

According to one embodiment, the buttocks cushion may be configured in a U-shape to support the lower body of the newborn and prevent the newborn from slipping.

According to one embodiment, the backrest cushion and the buttocks cushion may be connected through a fastening means, and a fastening position of the fastening means may be adjusted according to a growth state of the newborn.

According to one embodiment, the backrest cushion may include a first backrest cushion inclined at a first angle toward the buttocks cushion and constituting a backrest region having a first area where the newborn is able to be laid and a second backrest cushion inclined at a second angle smaller than the first angle toward the buttocks cushion and constituting a backrest region having a second area greater than the first area.

BRIEF DESCRIPTION OF THE DRAWINGS

The above and other objects, features, and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, embodiments of the present disclosure will be described in detail with reference to the accompanying drawings.

Figure 1:
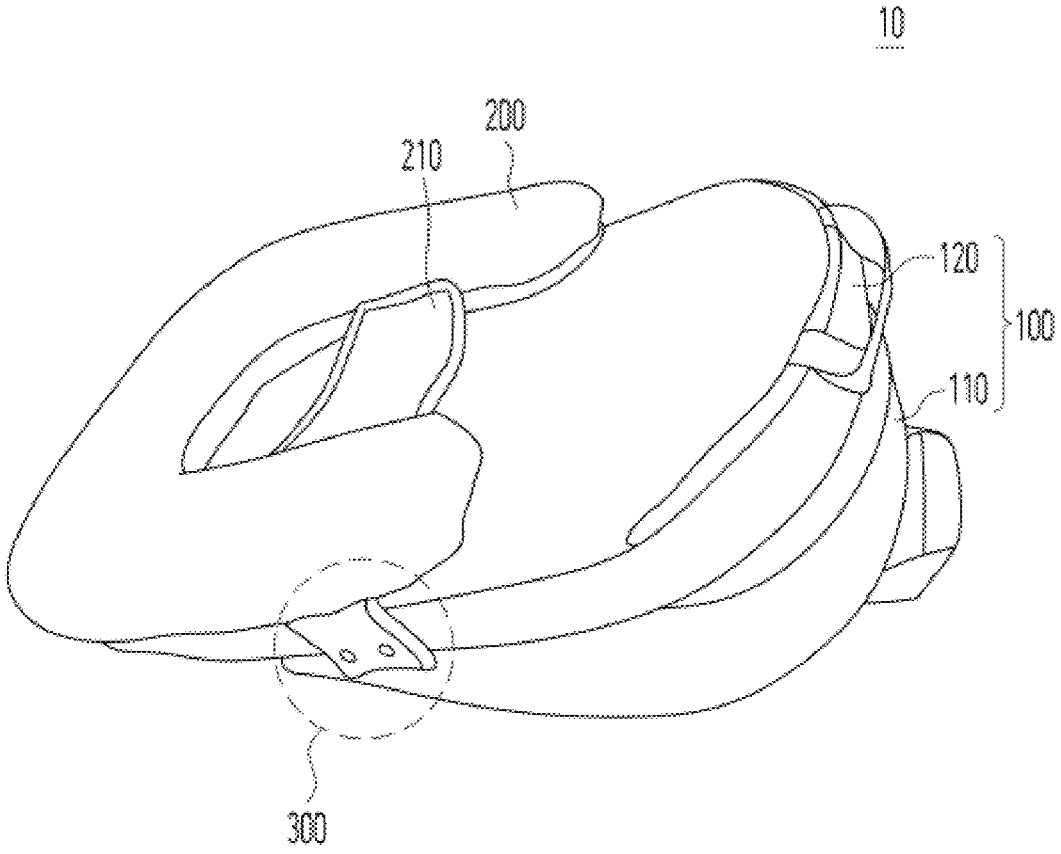
FIG. 1 is a view illustrating a reflux-preventing cushion according to an embodiment of the present disclosure.

FIG. 1 is a view illustrating a reflux-preventing cushion 10 according to an embodiment of the present disclosure.

Referring to FIG. 1, the reflux-preventing cushion 10 of the present disclosure may include a backrest cushion 100 and a buttocks cushion 200. The backrest cushion 100 may be configured to be inclined at a certain angle and allow a newborn to be laid to prevent digestive reflux in the newborn. The buttocks cushion 200 may include a pair of bands 210 configured to cover the newborn from both sides of the body of the newborn in a state in which the newborn is laid on the backrest cushion 100. The buttocks cushion 200 may be connected to the backrest cushion 100 through a fastening means 300 and may prevent the newborn from slipping in a direction in which the backrest cushion 100 is inclined when the newborn is laid.

An uncurved sponge filler may be used as the backrest cushion 100 to thoroughly support the waist of the newborn. The sponge filler may firmly support the waist unlike memory foam or cotton, and highly elastic sponge foam may be used as the filler to firmly support the waist without being sunken.

The buttocks cushion 200 may be configured in a U-shape to support the lower body of the newborn and prevent the newborn from slipping in the direction in which the backrest cushion 100 is inclined, and both side surfaces of the U-shape may be used as a body pillow when the newborn sleeps. It may take a long time for bent hip joints of a newborn to naturally unbend, and the buttocks cushion 200 may allow the newborn to lay in a natural posture by preventing the lower body of the newborn from reaching an "11"-shaped posture and naturally bending the hip joints. That is, by allowing the lower body of the newborn to reach an M-shaped posture by being placed on the buttocks cushion 200, dislocation of the hip joints can be prevented.

Figure 2:
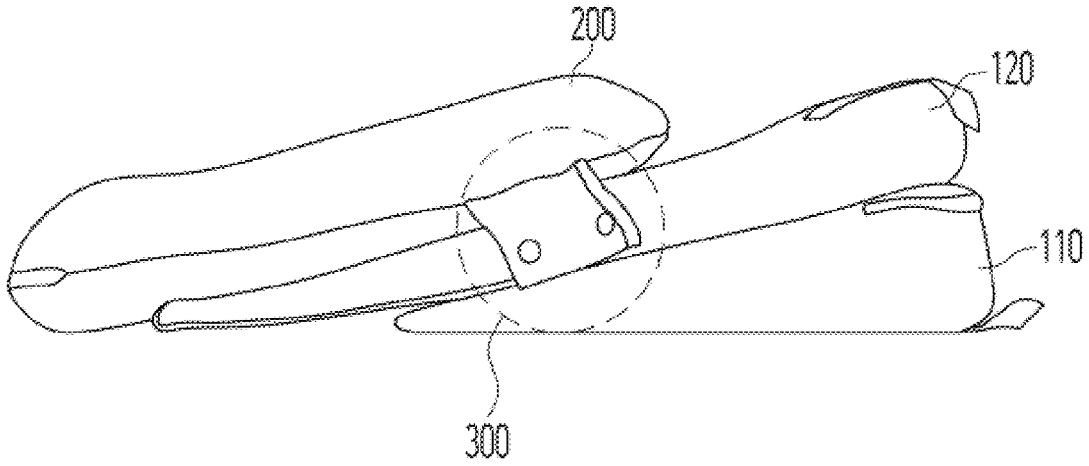
FIG. 2 is a view illustrating a fastening means between a backrest cushion and a buttocks cushion according to one embodiment.

FIG. 2 is a view illustrating the fastening means 300 between the backrest cushion 100 and the buttocks cushion 200 according to one embodiment.

Referring to FIG. 2, the backrest cushion 100 may include a first backrest cushion 110 inclined at a first angle toward the buttocks cushion 200 and constituting a backrest region having a first area where the newborn is able to be laid and a second backrest cushion 120 inclined at a second angle smaller than the first angle toward the buttocks cushion 200 and constituting a backrest region having a second area greater than the first area. At this time, a caregiver may use only one of the first backrest cushion 110 and the second backrest cushion 120 or use both the first backrest cushion 110 and the second backrest cushion 120 according to a growth state of the newborn.

A position at which the buttocks cushion 200 of the present disclosure is fastened to the backrest cushion 100 may be adjusted, a suitable backrest cushion 100 may be selected among the first backrest cushion 110 and the second backrest cushion 120 according to the growth state of the newborn, and the buttocks cushion 200 may be mounted on the selected backrest cushion 100. For example, the buttocks cushion 200 and the backrest cushion 100 may be mounted through the fastening means 300. A pair of female buttons may be provided as the fastening means 300 on the buttocks cushion 200, and four male buttons may be provided as the fastening means 300 on the backrest cushion 100. At this time, the caregiver may select two neighboring male buttons among the four male buttons according to the growth stage of the newborn and may fasten the selected male buttons to the pair of female buttons.

According to one embodiment, when the first backrest cushion 110 and the second backrest cushion 120 are used together, the lower backrest cushion between the first backrest cushion 110 and the second backrest cushion 120 may be connected to the buttocks cushion 200 through the fastening means 300. For example, the number of the female buttons of the buttocks cushion 200 may be four, and the four female buttons may be disposed in a 2x2 structure. Accordingly, the upper female buttons may be connected to the upper backrest cushion between the first backrest cushion 110 and the second backrest cushion 120, and the lower female buttons may be connected to the lower backrest cushion between the first backrest cushion 110 and the second backrest cushion 120.

For 1- to 50-day-old newborns, the two male buttons on an upper portion of the backrest cushion 100 and the female buttons of the buttocks cushion 200 may be connected, for 50- to 150-day-old newborns, the two male buttons on an intermediate portion of the backrest cushion 100 and the female buttons of the buttocks cushion 200 may be connected, and for 150-day-old to 1-year-old newborns, the two male buttons on a lower portion of the backrest cushion 100 and the female buttons of the buttocks cushion 200 may be connected.

According to one embodiment, the backrest cushion 100 of the present disclosure may further include a third backrest cushion (not illustrated) that does not have a slope. The third backrest cushion is a cushion without a difference between a height corresponding to the head part and a height corresponding to the buttocks part when the newborn is laid, and may be disposed on an upper end of the second backrest cushion 120. When the newborn has fallen asleep after the third backrest cushion is used together with the first backrest cushion 110 and/or the second backrest cushion 120, the caregiver may remove the first backrest cushion and the second backrest cushion to use the reflux-preventing cushion 10 of the present disclosure as a baby bed. In other words, comfortable, sound sleep of the newborn may be ensured by further including the third backrest cushion that is not inclined and has a slope of 0° in addition to the first backrest cushion and the second backrest cushion that are inclined to prevent reflux. Meanwhile, the third backrest cushion may also include at least one male button and may be connected to the buttocks cushion 200.

Figure 3:
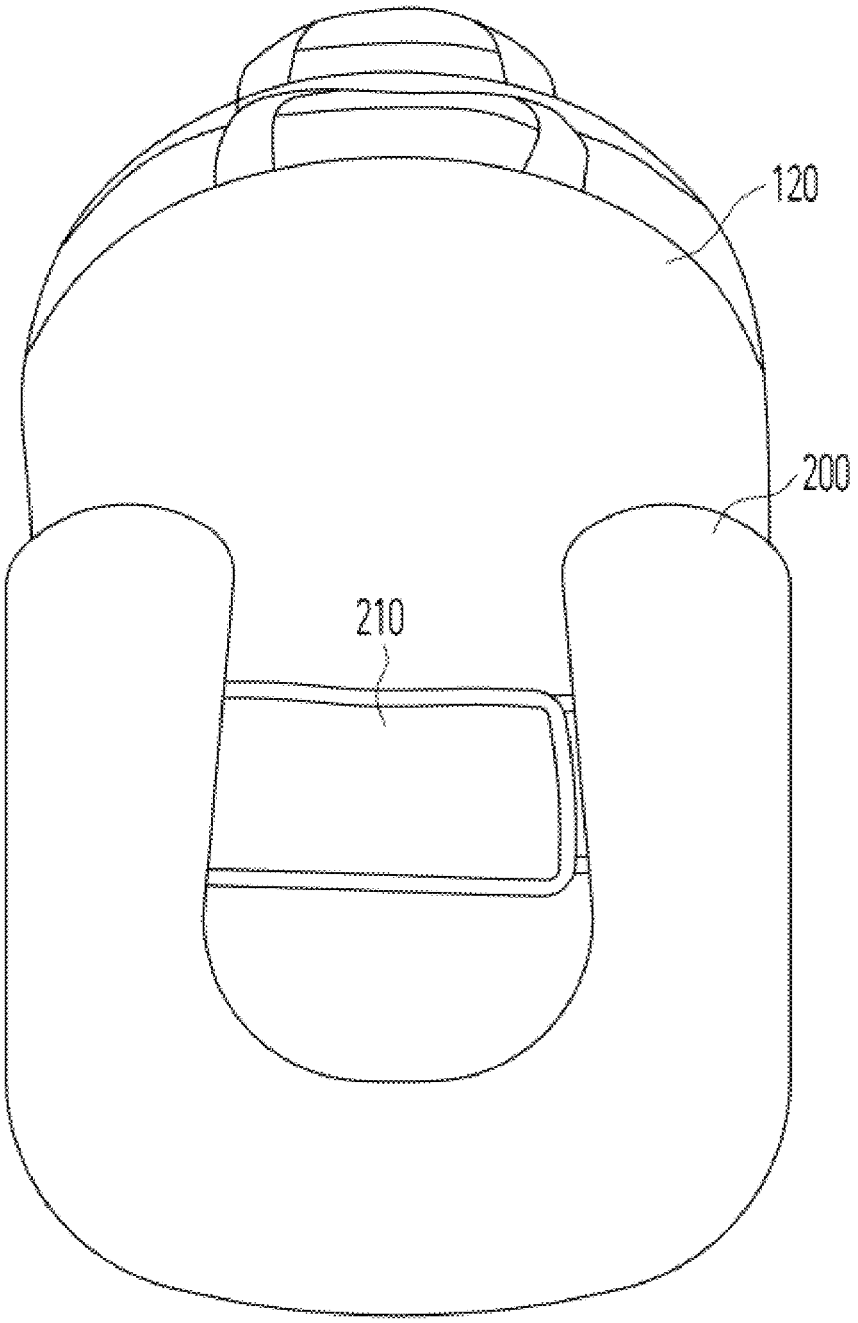
FIG. 3 is a view illustrating a pair of bands according to one embodiment.

FIG. 3 is a view illustrating the pair of bands 210 according to one embodiment.

Up to 6-month-old newborns exhibit the Moro reflex in which they bend their back, throw their hands and arms out to the front, and pull their arms back toward their body as if they are trying to hold something in response to a sudden loud noise or change in the position of the head. Newborns who exhibit the Moro reflex may startle and be awakened from sleep or sleep fitfully in many cases, and the newborns may feel psychologically unstable.

Bands previously used in reflux-preventing cushions 10 have fixed newborns to prevent the newborns from slipping or moving using a hook-and-loop fastener material that causes a loud noise or a method with a relatively weak fixing strength to reduce the loud noise. Therefore, for the bands made of the hook-and-loop fastener material having a strong fixing strength, since a loud noise is generated when the bands in contact with each other are detached, a newborn may exhibit the Moro reflex or may be awakened from sleep.

On the other hand, the pair of bands 210 used in the present invention cause very low noise and can fix a newborn using a method with a strong fixing strength. As a result of repeated experiments, in a typical household environment with a newborn where the surrounding noise was measured to be 40 to 45 dB, the noise measured at the head part of the newborn when detaching hook-and-loop fasteners was 45 to 50 dB, and it was confirmed that noise of 5 dB was generated for the newborn when detaching the hook-and-loop fasteners. Considering that sound caused by human breathing in a quiet environment is about 10 dB, it can be confirmed that noise that may interrupt sound sleep of a newborn was not generated at all. Meanwhile, the noise produced when attaching the hook-and-loop fasteners to each other was almost immeasurable.

Figure 4:
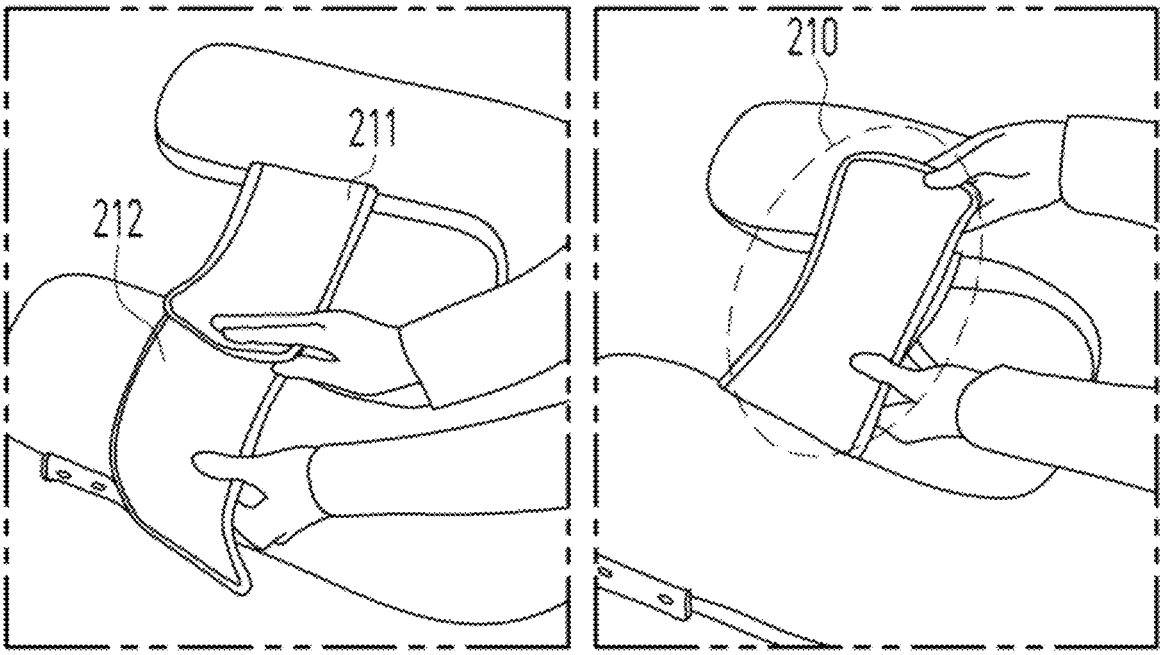
FIG. 4 is a view illustrating an embodiment in which the pair of bands are fastened according to one embodiment.

FIG. 4 is a view illustrating an embodiment in which the pair of bands 210 are fastened according to one embodiment.

Referring to FIG. 4, the pair of bands 210 may consist of a first band 211 and a second band 212. The first band 211 may include a first surface woven using a first plain gauze weave method, and the second band 212 may include a second surface woven using a second plain gauze weave method different from the first plain gauze weave method. The pair of bands 210 may fix the newborn and prevent the newborn from moving through fastening between the first surface and the second surface. At this time, since very low noise is generated when the first surface and the second surface are attached to or detached from each other, the newborn is able to use the reflux-preventing cushion 10 without feeling uncomfortable.

According to one embodiment, the first plain gauze weave method may be a method in which a plurality of first filament bundles in which 90 to 100 filament fibers are tied into one strand and a plurality of second filament bundles in which 40 to 50 filament fibers are tied into one strand are mixed. At this time, the first filament bundles may be configured to be 200 deniers, and the second filament bundles may be configured to be 100 deniers.

The first filament bundles and the second filament bundles of the first plain gauze weave method may be made of a draw textured yarn (DTY) material which is a synthetic fiber. The DTY material may be stretch yarn or textured yarn formed by bulking filaments and making them flexible in a texturing process or may be threads formed so that soft synthetic yarn feels like natural yarn.

The second plain gauze weave method may be a method in which the 200 denier first filament bundles and 100 denier island-in-sea fiber yarn are mixed. That is, the second plain gauze weave method may be a plain gauze weave method in which the 100 denier island-in-sea fiber yarn is used in place of the 100 denier second filament bundles in the first plain gauze weave method.

Island-in-sea fibers may be fibers made of two or more types of polymers and may be fibers having a structure in which "island" components made of any one polymer are dispersed in a "sea" component made of another polymer. The island-in-sea fibers have features of being highly elastic, soft, and glossy. In addition, the island-in-sea fibers have low deformation, high durability and air permeability, and cause little irritation even when in contact with the skin. Therefore, when the first band 211 and the second band 212 are fastened, a portion of the second surface woven using the second plain gauze weave method including the island-in-sea fibers may be located to be disposed toward the newborn.

Figure 5:
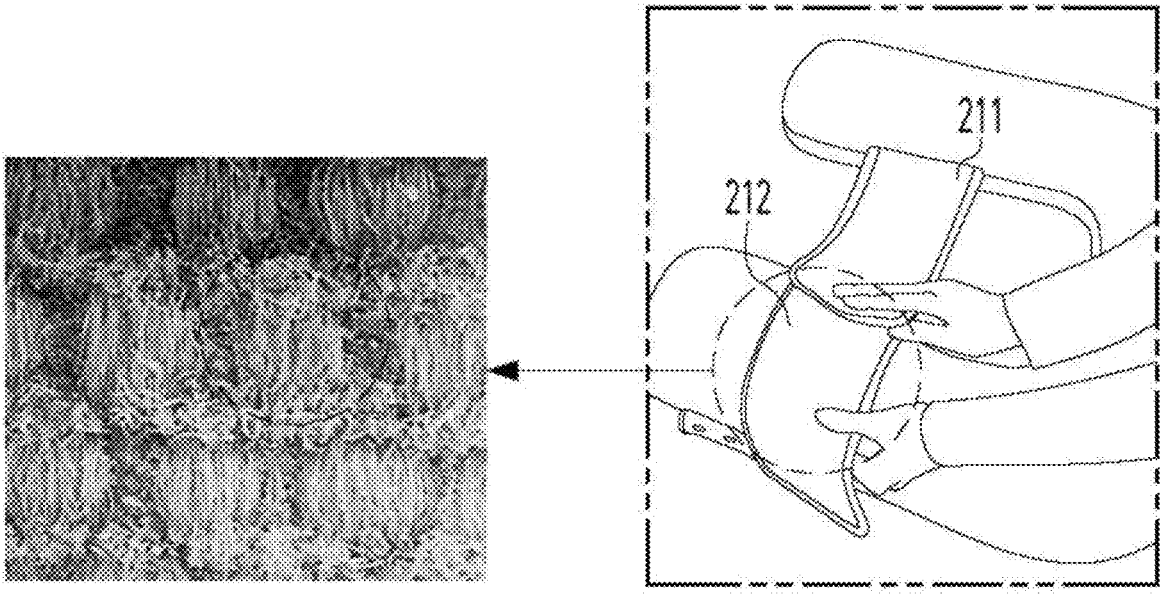
FIG. 5 is a view illustrating surfaces of the bands that come into contact according to one embodiment.
Figure 6:
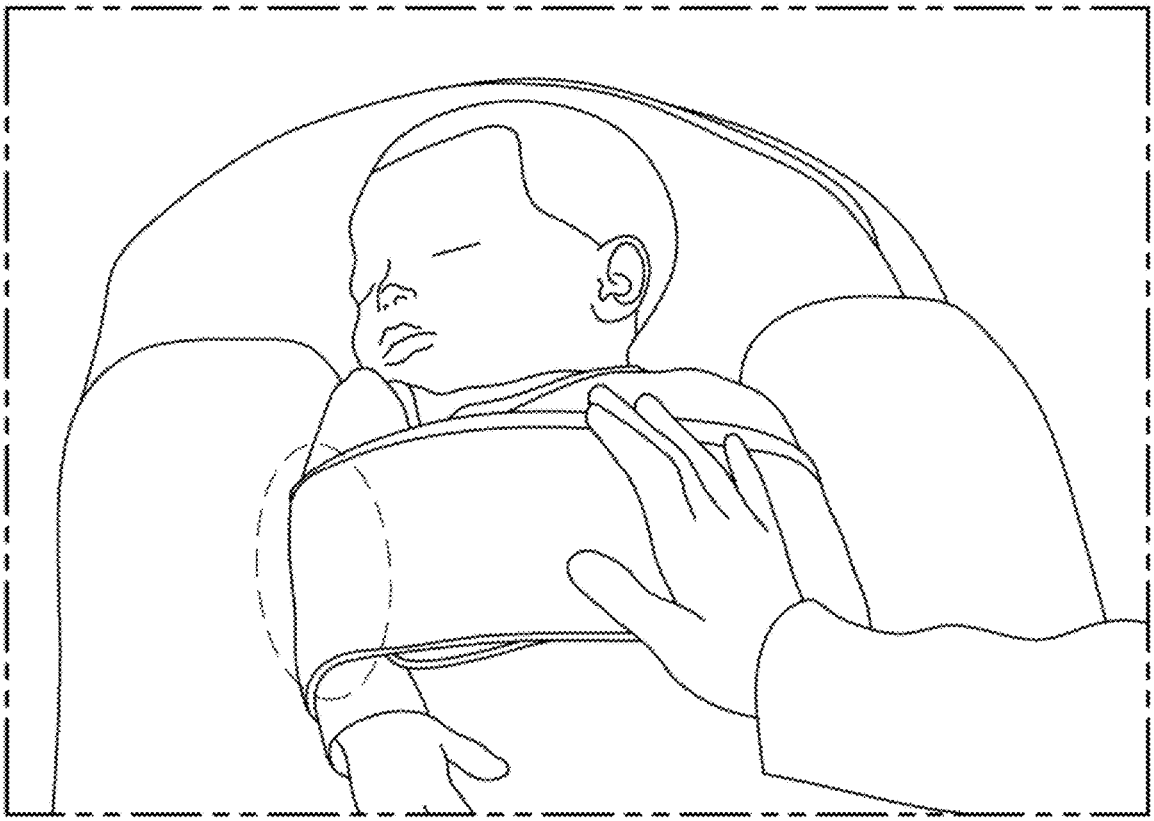
FIG. 6 is a view illustrating a situation in which a second band is in contact with the skin of a newborn according to one embodiment.

FIG. 5 is a view illustrating surfaces of the bands that come into contact according to one embodiment, and FIG. 6 is a view illustrating a situation in which the second band 212 is in contact with the skin of a newborn according to one embodiment.

Referring to FIGS. 5 and 6, the first surface and the second surface may come into contact with each other and allow fastening to be smoothly performed, and a strong fastening strength may be maintained. The fastening strength between the first surface and the second surface may be measured using a tension-shear strength and a peel strength. In addition, compared to a hook-and-loop fastener material which is a previous attaching means between surfaces in contact with each other, since a fastening strength relative to noise and a fastening strength relative to roughness are significantly higher, the reflux-preventing cushion 10 can be used without causing much auditory/tactile stimulation to the newborn, and convenience of the caregiver can be further enhanced.

The fastening strength may be higher with an increase in the height of the shape of a concave-convex portion or bush formed on a surface, but the increase in the height of the concave-convex portion or bush gives a gritty feeling. That is, an increase in a difference between the lowest height and highest height of an adhesive surface may cause an increase in the fastening strength and surface roughness. The hook-and-loop fastener material, which is a previous attaching means, increases the fastening strength using such a feature, but since the surface roughness also increases, it has an aspect of not being suitable for use in products for newborns.

On the other hand, an adhesive surface of the first surface and the second surface according to an embodiment of the present disclosure is configured to be suitable for use in products for newborns because the fastening strength is high despite being made of a smooth material with low roughness.

According to Korean Patent Registration No. 10-1096112 (Date of Announcement: Dec. 19, 2011), shear strengths of hook-loop tapes according to a plurality of embodiments were measured to be 3.1 kg, 3.3 kg, and 3.6 kg. The hook-loop tapes are hook-and-loop fastening tapes conventionally used as a typical attaching means. On the other hand, shear strengths of the pair of bands 210 according to an embodiment of the present disclosure were measured to be 6 kg to 8.5 kg.

In addition, since the roughness of the adhesive surface of the pair of bands 210 according to an embodiment of the present disclosure is significantly lower compared to the roughness of the hook-and-loop fastener material, a functional aspect in which a portion in contact with the skin of the newborn should be smooth can be satisfied even with a strong fastening strength.

Figure 7:
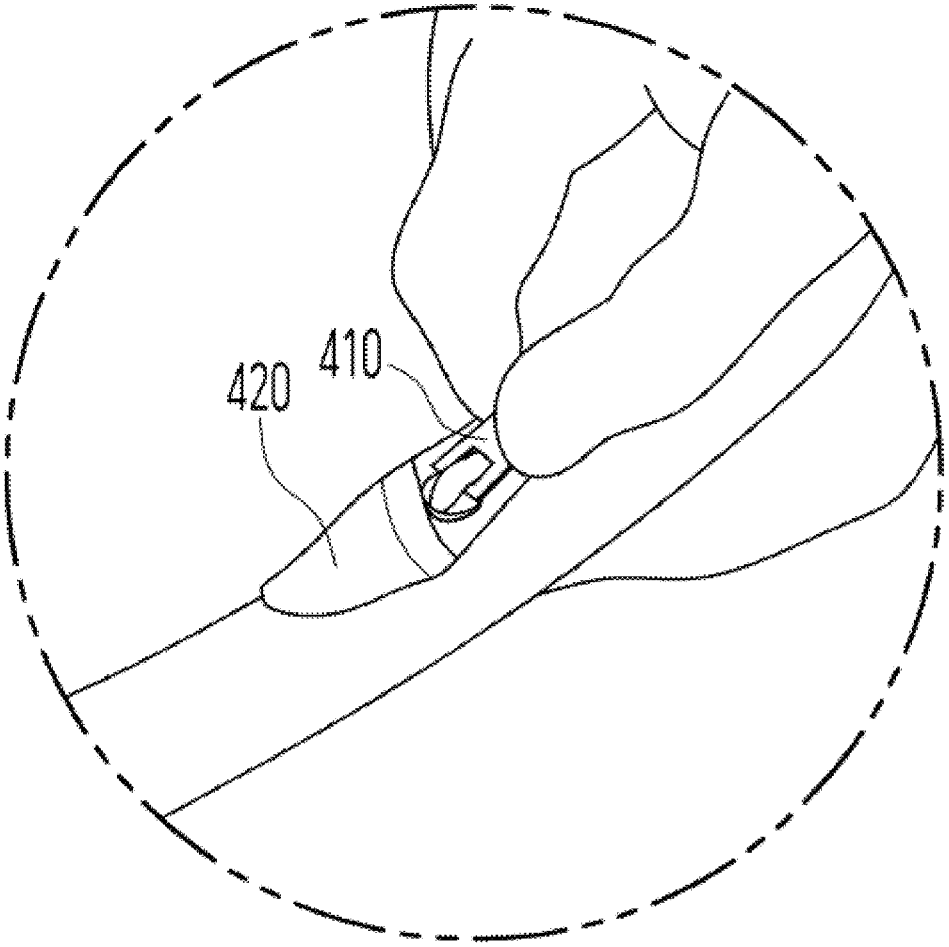
FIG. 7 is a view illustrating a hidden zipper pull according to one embodiment.

FIG. 7 is a view illustrating a hidden zipper pull 410 according to one embodiment.

Referring to FIG. 7, the buttocks cushion 200 and the backrest cushion 100 of the present disclosure may be made of an outer cover, a waterproof cover, and a sponge filler that are washable. The sponge filler may be accommodated in the waterproof cover, and the outer cover may accommodate the waterproof cover and the sponge filler. At this time, the outer cover may be closed by a zipper and the zipper pull 410 while accommodating the waterproof cover and the sponge filler.

A flexible material 420 that can hide the zipper pull 410 may be formed on one side end of zipper teeth arranged in a row. The flexible material 420 may form a predetermined opening in the form of a pouch that can accommodate the zipper pull 410 and may be made of a highly flexible band material to accommodate the zipper pull 410.

The flexible material 420 may be configured in both the buttocks cushion 200 and the backrest cushion 100, and a case in which a newborn is injured by the zipper pull 410 can be prevented by hiding the zipper pull 410 in the flexible material 420. In addition, by hiding the zipper pull 410 in the flexible material 420 during washing, a case in which the zipper pull 410 entangles with other laundry in a wash tub and a case in which the wash tub is damaged can be prevented.

According to one embodiment, the reflux-preventing cushion 10 may further include a head pillow located on a head portion of the backrest cushion 100. The head pillow may have a groove formed therein to correspond to the head shape of the newborn. In addition, the reflux-preventing cushion 10 may further include a blanket, and the blanket may be configured to be hung on one portion of the reflux-preventing cushion 10 through a hook member.

A reflux-preventing cushion according to an embodiment of the present disclosure can prevent a newborn from slipping and can increase convenience in use by a surface in contact with the skin of the newborn being formed to be soft. In particular, a pair of bands for fixing the newborn can stably fix the newborn due to softness of surfaces in contact with the newborn and a high fastening strength. In addition, since a loud noise is not generated in a process of detaching the pair of bands, the sleeping newborn is not woken up, and convenience can be enhanced for a caregiver.

Effects that can be obtained by exemplary embodiments of the present disclosure are not limited to those mentioned above, and other unmentioned effects can be clearly derived and understood by those of ordinary skill in the art to which the exemplary embodiments of the present disclosure pertain from the description above. That is, unintended effects according to carrying out the exemplary embodiments of the present disclosure may also be derived by those of ordinary skill in the art from the exemplary embodiments of the present disclosure.

Exemplary embodiments have been disclosed above and in the drawings. Although specific terms have been used to describe the embodiments herein, the terms are only used for the purpose of describing the technical idea of the present disclosure and are not used to limit meanings or limit the scope of the present disclosure stated in the claims. Therefore, those of ordinary skill in the art should understand that various modifications and other equivalent embodiments are possible therefrom. Accordingly, the true technical protection scope of the present disclosure should be defined by the technical idea of the appended claims.

What is claimed is:

1. A reflux-preventing cushion for preventing digestive reflux that occurs in a newborn, the reflux-preventing cushion comprising:

a backrest cushion configured to be inclined at a certain angle and allow the newborn to be laid to prevent the digestive reflux; and a buttocks cushion including a pair of bands configured to cover the newborn from both sides of the body of the newborn in a state in which the newborn is laid on the backrest cushion, wherein the pair of bands include a first band including a first surface woven using a first plain gauze weave method and a second band including a second surface woven using a second plain gauze weave method different from the first plain gauze weave method, and the pair of bands is configured to fix the newborn through fastening between the first surface and the second surface.

2. The reflux-preventing cushion of claim 1, wherein, in the first plain gauze weave method, a plurality of 200 denier first filament bundles in which 90 to 100 filament fibers are tied into one strand and a plurality of 100 denier second filament bundles in which 40 to 50 filament fibers are tied into one strand are mixed.

3. The reflux-preventing cushion of claim 2, wherein:

in the second plain gauze weave method, the 200 denier first filament bundles and 100 denier island-in-sea fiber yarn are mixed; and when the first band and the second band are fastened, a portion of the second surface woven using the second plain gauze weave method is configured to be disposed toward the newborn.

4. The reflux-preventing cushion of claim 1, wherein the buttocks cushion is configured in a U-shape to support the lower body of the newborn and prevent the newborn from slipping.

5. The reflux-preventing cushion of claim 1, wherein the backrest cushion and the buttocks cushion are connected through a fastening means, and a fastening position of the fastening means is configured to be adjusted according to a growth state of the newborn.

6. The reflux-preventing cushion of claim 1, wherein the backrest cushion includes:

a first backrest cushion inclined at a first angle toward the buttocks cushion and constituting a backrest region having a first area configured to support the newborn; and a second backrest cushion inclined at a second angle smaller than the first angle toward the buttocks cushion and constituting a backrest region having a second area greater than the first area.

7. The reflux-preventing cushion of claim 6, wherein the backrest cushion further includes a third backrest cushion that is not inclined and has a slope of 0° unlike the first backrest cushion and the second backrest cushion and is disposed on an upper end of the second backrest cushion.

* * * * *